US007121441B2

(12) United States Patent
Nayrac et al.

(10) Patent No.: US 7,121,441 B2
(45) Date of Patent: Oct. 17, 2006

(54) GAS-OPERATED APPARATUS FOR DRIVING AN ELEMENT USING A PISTON

(75) Inventors: Frederic Nayrac, Bourg les Valence (FR); Bruno Toulouse, Valence (FR)

(73) Assignee: Societe de Prospection et d'Inventions Techniques Spit, Bourg-les-Valence (FR)

( * ) Notice: Subject to any disclaimer, the term of this patent is extended or adjusted under 35 U.S.C. 154(b) by 21 days.

(21) Appl. No.: 10/888,582

(22) Filed: Jul. 12, 2004

(65) Prior Publication Data

US 2005/0023320 A1 Feb. 3, 2005

(30) Foreign Application Priority Data

Jul. 29, 2003 (FR) ..... 03 09321

(51) Int. Cl.
*B25C 1/14* (2006.01)

(52) U.S. Cl. ..... 227/8; 227/10; 227/130

(58) Field of Classification Search ..... 227/8, 227/142, 130, 10
See application file for complete search history.

(56) References Cited

U.S. PATENT DOCUMENTS

| | | | | |
|---|---|---|---|---|
| 4,483,473 | A | 11/1984 | Wagdy | |
| 4,483,474 | A * | 11/1984 | Nikolich | 227/8 |
| 5,197,646 | A * | 3/1993 | Nikolich | 227/8 |
| 5,199,626 | A * | 4/1993 | Terayama et al. | 227/10 |
| 5,713,313 | A * | 2/1998 | Berry | 123/46 SC |
| 5,909,836 | A * | 6/1999 | Shkolnikov et al. | 227/8 |
| 6,138,887 | A * | 10/2000 | Nayrac et al. | 227/8 |
| 6,145,724 | A * | 11/2000 | Shkolnikov et al. | 227/8 |
| 6,964,362 | B1 * | 11/2005 | Shkolnikov et al. | 227/130 |
| 2003/0034377 | A1 | 2/2003 | Porth et al. | |

* cited by examiner

*Primary Examiner*—Scott A. Smith
(74) *Attorney, Agent, or Firm*—Lowe Hauptman & Berner, LLP

(57) ABSTRACT

In the apparatus, under the action of the explosion of a mixture of air and gas in a chamber closed by a chamber sleeve tube and a cage when the apparatus is pressed against something, a piston is propelled in a cylinder to drive an element. The chamber sleeve tube and the cylinder are arranged in such a way that, as the apparatus is closed, the chamber sleeve tube comes into abutment against the cylinder.

The invention can well be applied to nail guns and other staplers.

14 Claims, 3 Drawing Sheets

Fig. 5
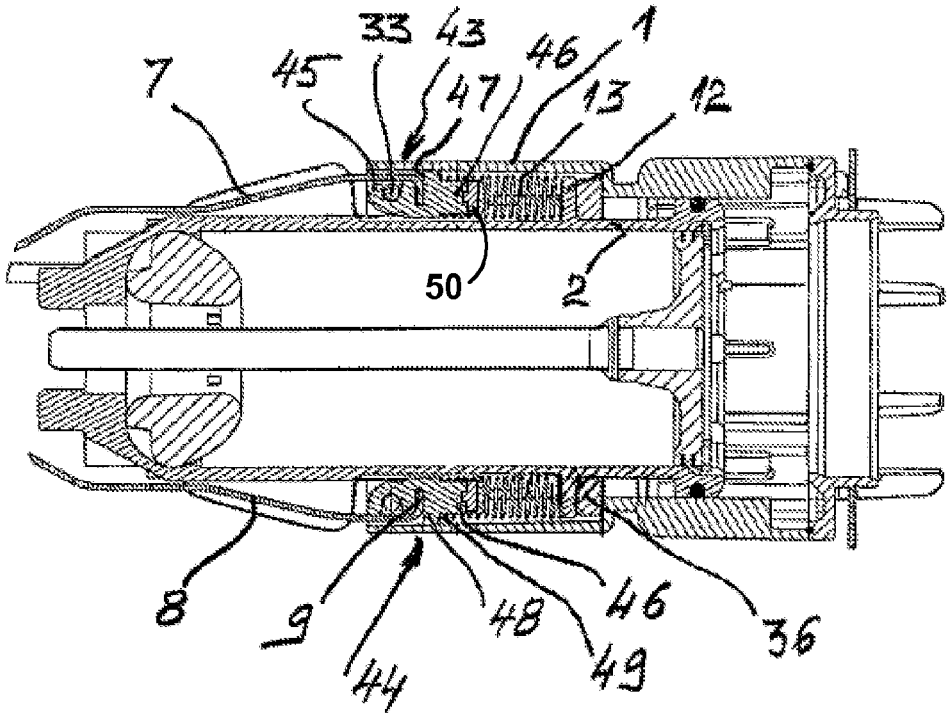
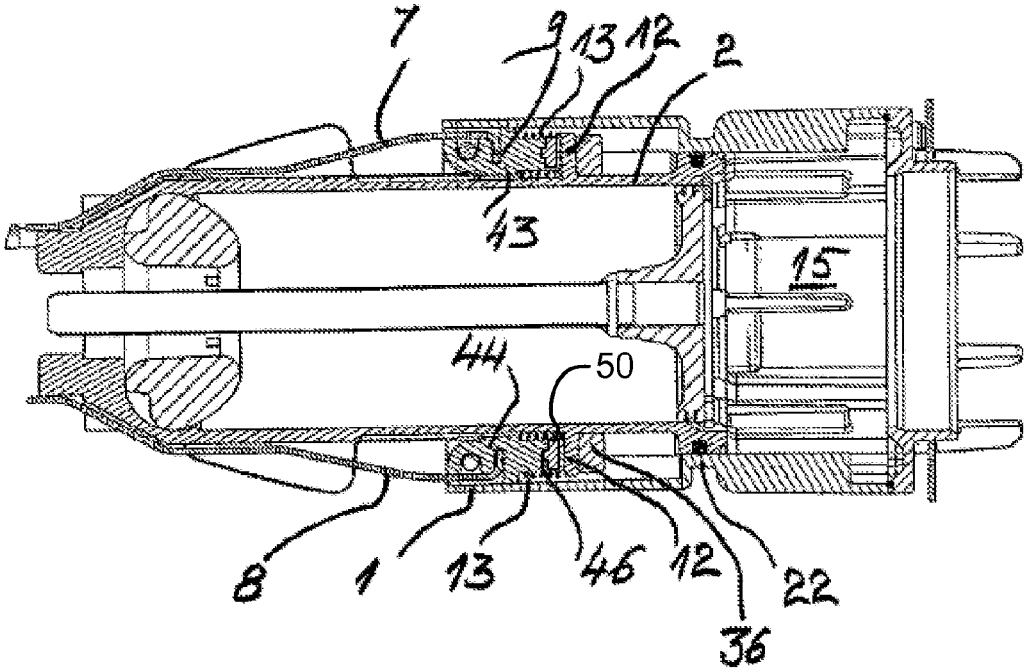
Fig. 6

GAS-OPERATED APPARATUS FOR DRIVING AN ELEMENT USING A PISTON

RELATED APPLICATIONS

The present application is based on, and claims priority from, French Application Number 03 09321, filed Jul. 29, 2003, the disclosure of which is hereby incorporated by reference herein in its entirety.

The invention relates to an apparatus for sealing or for piercing or for driving or for hammering in any element into a receiving material, of the nail gun, staple gun or hammer type, powered by gas.

BACKGROUND OF THE INVENTION

In such an apparatus, a piston is mounted so that it can move in a cylinder where it can be propelled, by the explosion of a mixture of air and a fuel gas injected, from a cartridge, into a combustion chamber and to drive an element, for example a fastener (a nail or an insert) or some other anchor. Apart form the bearing-against-something safety feature, that prevents any firing when the apparatus is not pressed against a receiving material, this kind of apparatus has a member, known as a cage, which, when the apparatus is pressed against something, and by way of a feeler that may be a moving insert guide, pushes a chamber sleeve tube back until it comes into abutment against the cylinder head that carries the spark plug intended to cause the explosion, so as to close the combustion chamber thus formed by this sleeve tube, the cylinder head and the crown of the piston. The cage and the sleeve tube may be connected to one another by screwing. Furthermore, the retreat of the cage is performed against the action of a return spring, to return the apparatus to the open position, also bearing against the piston cylinder.

Because the combustion chamber bears against the cylinder head, stressful pressures are exerted on the cylinder head when such an apparatus is operating, particularly since the surface portions of the cylinder head and of the cylinder face one another. Even if, in other apparatuses, these detrimental pressures are no longer exerted on the cylinder head, they are transferred to the cage, which is not necessarily any better.

SUMMARY OF THE INVENTION

The invention in this application aims to dispense with any parasitic pressure stress on both the cylinder head and the cage.

To this end, the invention relates to a gas-operated apparatus in which, under the action of the explosion of a mixture of air and gas in a chamber closed by a chamber sleeve tube and a cage when the apparatus is pressed against something, a piston is propelled in a cylinder to drive an element, characterized in that the chamber sleeve tube and the cylinder are arranged in such a way that, as the apparatus is closed, the chamber sleeve tube comes into abutment against the cylinder.

An element is to be understood as meaning either a nail, an insert, an anchor, a staple or any similar element.

In one embodiment of the apparatus of the invention, the cage and the chamber sleeve tube are connected with clearance in sliding, so as to avoid the propagation of stresses.

The chamber sleeve tube may comprise at least one bearing pad intended to come into abutment against a bearing lug of the cylinder, at least one connecting pin connecting the chamber sleeve tube and the cage, and at least one lug acting as a support for an opening spring, bearing also against a flange of the cylinder, and a member whereby the chamber sleeve tube and the cage can push one another.

The chamber sleeve tube may also comprise at least one bearing, thrust and connecting pad arranged to come into abutment against a bearing flange of the cylinder in the closed position, at least one connecting pin for connecting the chamber sleeve tube, the bearing pad and the cage and at least one spring for opening the chamber in abutment against the bearing flange and the bearing pad.

In this case, it is advantageous for the pad to bear a bearing finger of narrowed cross section designed to bear against the flange of the cylinder and receive the opening spring.

BRIEF DESCRIPTION OF THE DRAWING

The invention will be better understood with the aid of the following description of two forms of embodiment of the apparatus of the invention, with reference to the attached drawing in which:

FIG. 5 is a view in axial section of the second embodiment of the apparatus in an open position, and FIG. 6 is a view in axial section of the apparatus of FIG. 5, in a closed position.

DETAILED DESCRIPTION OF THE INVENTION

Figure 1:
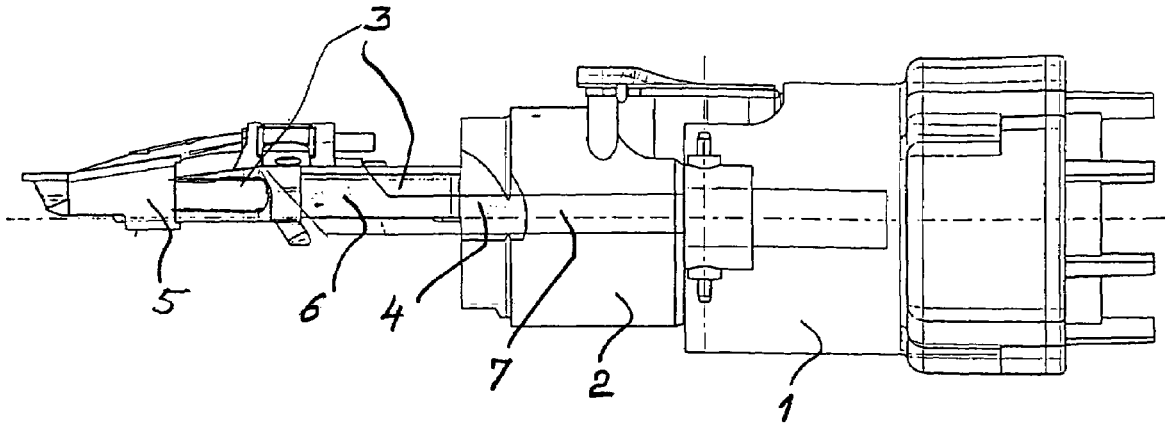
FIG. 1 is a profile view of the first embodiment of the apparatus, in an open position.

At the front of the cylinder head, bearing a spark plug and a motor fan unit, these elements of the apparatus not being depicted any more than are the holding and actuating handle, the gas cartridge and the anchoring element loader, the apparatus comprises a chamber sleeve tube 1, a cylinder 2 with a smaller cross-section front portion 3, a cage 4 for closing off the chamber, and a feeler 5.

The feeler 5, now commonplace, is secured in terms of translation to the cage, here by screws, a semi-tubular front portion 6 of which cage envelopes the rear of the feeler. The front portion 6 of the cage 4 is extended, rearwards, by two lateral arms 7, 8 the rear end 9 of which is elbowed towards the axis 16 of the apparatus to form a connecting nib.

The two arms 7, 8 of the cage extend along the cylinder 2, on the outside, as far as the front part 10 of the chamber sleeve tube 1.

On its outer wall, the cylinder 2 bears radial bearing lugs 11 to act as stops for the chamber sleeve tube 1 in the closed position and, behind the bearing lugs 11, radial bearing flanges 12, acting as stops for return springs 13 for returning the chamber to the open position.

In a way which is conventional, which is why the description will not be expanded upon further regarding this point, the rear 14 of the chamber sleeve tube 1 partially forms the combustion chamber 15 of the apparatus.

Mounted in the cylinder 2 is a propulsion piston 17, with its crown 18, also for partially forming the chamber 15, and its propulsion rod 19. The cylinder has a rear bulge 20 in which there is formed a groove for housing a seal 21 intended, in the closed position, with the chamber sleeve tube 1, to seal the front of the combustion chamber 15.

For this, the chamber sleeve tube 1, in the central part and in a transverse portion perpendicular to the axis 16, has, in the axial continuation of a thickening of a chamber sleeve tube which will be dealt with more fully hereinafter, an interior rib portion 22 collaborating with the seal 21 in the closed position.

Figure 2:
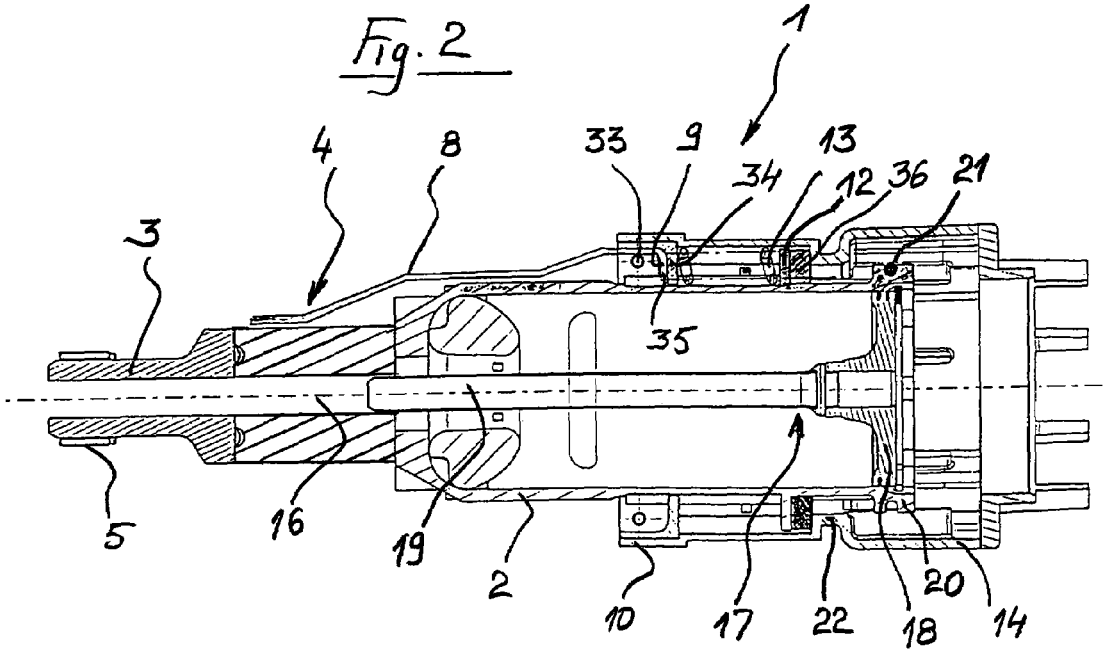
FIG. 2 is a view in axial section of the apparatus of FIG. 1, in an open position.
Figure 4:
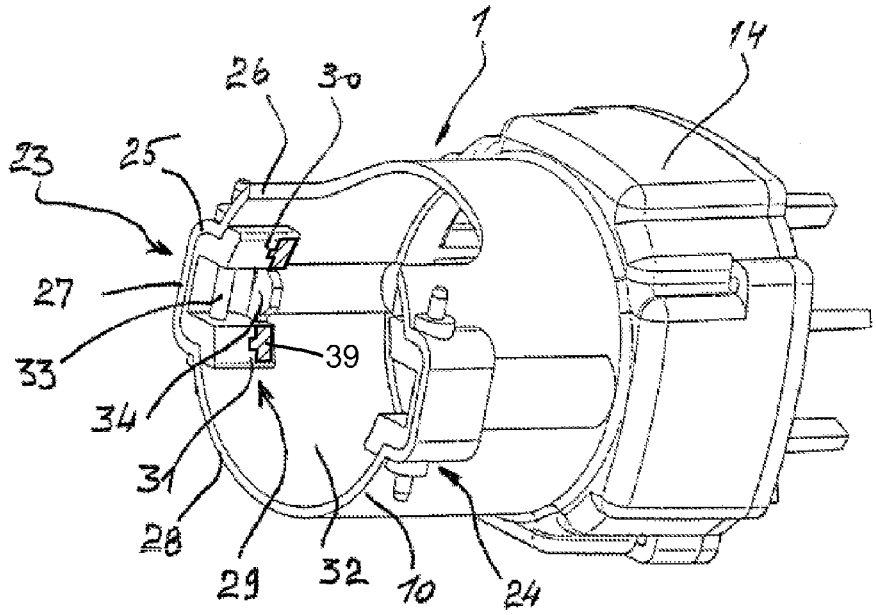
FIG. 4 is a perspective view with partial cutaway of the sleeve tube of the apparatus of FIG. 1.

It is the anterior part 10 of the chamber sleeve tube which will now be described more specifically. Here it comprises, at the edge of the sleeve tube and diametrically opposed in the axial plane of section of FIG. 2, two bearing, thrust and connecting assemblies 23 and 24. Each assembly is housed in an external thickening 25 of the wall 26, with a flat bottom 27, running from the edge 28 of the sleeve tube over a relatively small axial width. Inside each thickening, and with the same axial width, is arranged a cradle 29 consisting of two bearing pads 30, 31 symmetric with respect to the axial plane defined hereinabove, hugging the thickening and, in the case of each, a small portion of the interior wall 32 of the sleeve tube. A connecting pin 33 passes through each thickening and its two pads 30, 31 at right angles to the same axial plane. Finally, a radial bearing lug 34 extends between the two bearing pads of each cradle 29, in the manner of an internal bottom, on the opposite side to the anterior edge 28 of the tube. The return springs 13 returning the chamber to the open position, bearing against the radial bearing faces 12 of the cylinder 2, also respectively bear against the bearing lugs 34 of the chamber sleeve tube 1. As for the connecting nib 9 of each arm 7, 8, it is passed, via its free end part 35, facing towards the axis 16, behind the associated connecting pin 33. Thus, the end part 35 of a connecting nib 9 of a cage arm 7, 8 can, here, relative to the chamber sleeve tube 1, be driven in relative sliding over a clearance travel of a length equal to the distance separating the bearing lug 34 and the connecting pin 33 of the associated cradle 29, making it possible to qualify the sliding connection between the cage and the sleeve tube as a connection involving play. This degree of freedom here avoids the propagation of stresses.

In another form of embodiment that will be dealt with hereinbelow, the cage and sleeve tube could be connected in terms of sliding without play.

The way in which the apparatus works will now be described.

Figure 3:
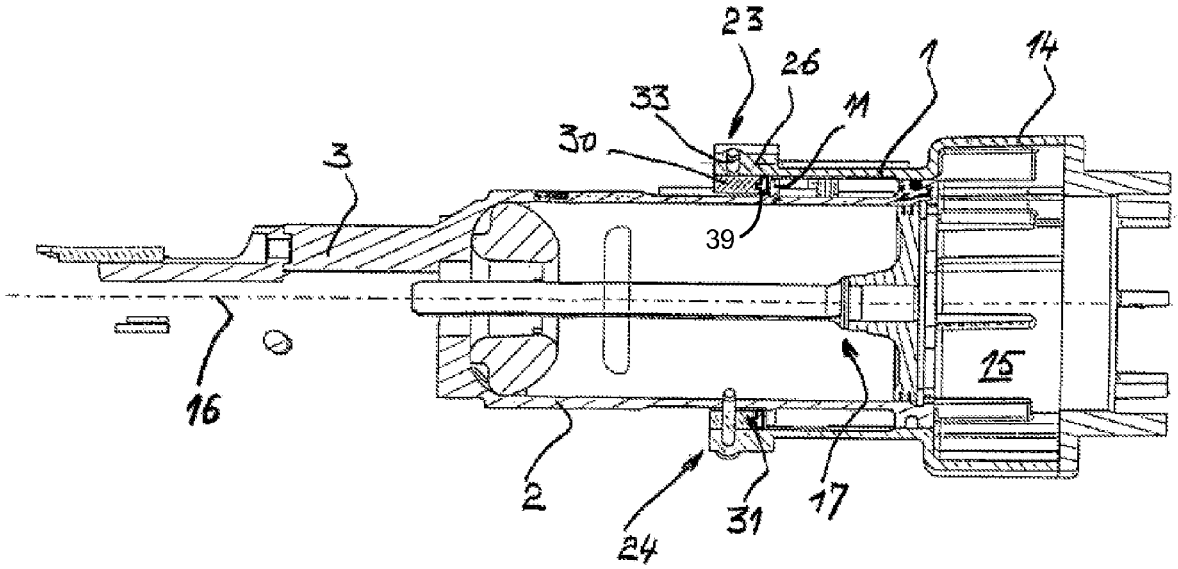
FIG. 3 is a view of the apparatus of FIG. 1 in a closed position, in axial section on a plane inclined by about 20° to the plane of section of FIG. 1.

When the apparatus is made to bear against a receiving material, the cage 6, via the feeler 5, is pushed towards the rear of the apparatus. The connecting nibs 9 begin by moving back from the connecting pin 33 as far as the bearing lug 34 of their associated bearing, thrust and connecting assembly before the cage 4, 6, via the bearing lugs 34 that act as thrusting members, pushes the chamber sleeve tube along the cylinder 2, compressing the return springs 13 (FIG. 2) until the bearing pads 30, 31 come into abutment against the bearing lugs 11 of the cylinder 2 (FIG. 3) and the combustion chamber 15 is thus closed, with sealing at the front.

The apparatus is then ready for firing.

When the apparatus is disengaged from the receiving material, the relaxation of the springs 13 causes the chamber sleeve tube 1 to slide forward along the cylinder 2, until the interior rib portions 22 of the sleeve tube come into abutment against dampers 36 bearing against the bearing flanges 12 of the cylinder and the apparatus finds itself back in the combustion chamber open position. As the chamber sleeve tube 1 slides in the opening direction, the thrust lugs 34 also drive the forward sliding of the connecting nibs 9 and therefore the arms 7, 8 of the cage 6. Under the action of its weight, the cage can continue its forward travel until the connecting arms 9 come into abutment against the pins 33.

Advantageously, the bearing pads 30,31 are made of damping material in order to better absorb the shocks. Alternately, these pads 30,31 comprise at least a transverse rear bearing slice 39 arranged to come into abutment against a bearing ear 11 which, as far as it is concerned, is made of damping material, slice inserted onto the pad, for instance by sticking, welding.

A chamber sleeve tube with two bearing, thrust and connecting assemblies, with clearance, each having a two-pad cradle has just been described.

In an alternative form of embodiment of the apparatus of the invention, which form is depicted in FIGS. 5, 6 in which the same references denote the same elements as in the other figures, each assembly is replaced by a single bearing, thrust and connecting pad 43, 44 shaped in a special way.

First of all, its shape is such that it can also be housed in one of the external thickenings 25, like the cradles 29. Furthermore, it has a connecting elbow 45 and a thrust and bearing finger 46 extending the connecting elbow 45. The connecting elbow 45, in the form of a bow, receives, in its concave internal groove, a connecting pin 33 which passes through the associated thickening 25. The connecting elbow 45 and the thrust and bearing finger 46 are connected to one another by a bridge, leaving between them a groove 47 for housing the connecting nib 9 of the associated cage arm 7, 8. As for the draft and bearing finger 46, it extends in cylindrical form from a base 48, which has a larger cross section than the finger 46, forming an annular shoulder 49 for the abutment of the spring 13 that opens the chamber in abutment at its other end against the bearing flange 12 of the cylinder 2.

The embodiment of FIGS. 5, 6 therefore essentially differs from that of the other figures through the following features:

- the cage 4 and the sleeve tube 1 are connected in sliding without play;
- the bearing lugs 11 have been eliminated;
- the pads 43, 44 are simpler that the cradles 29.

The way in which the apparatus of FIGS. 5 and 6 works is the same as the way in which the apparatus of the other figures works.

When the apparatus is pressed against a receiving material, the cage 4, via the feeler, is pushed towards the rear of the apparatus. The cage 4, via the nibs 9 and the fingers 46 of the pads, acting as thrust members, pushes the chamber sleeve tube 1 back along the cylinder 2, compressing the return springs 13 (FIG. 5) until the fingers 46 of the bearing pads 42, 44 come into abutment against the bearing flanges 12 of the cylinder 2 (FIG. 6) and the combustion chamber 15 is then closed, with sealing at the front.

The apparatus is then ready for firing.

When the apparatus is disengaged from the receiving material, the relaxation of the springs 13 causes the chamber sleeve tube 1 to slide forwards along the cylinder 2, until the interior rib portions 22 of the sleeve tube come into abutment against dampers 36 bearing against the bearing flanges 12 of the cylinder and the apparatus finds itself once again in the combustion chamber open position. As the chamber sleeve tube 1 slides in the opening direction, the thrust fingers 46 also drive the forward sliding of the connecting nibs 9 and therefore the arms 7, 8 of the cage 4.

The pads 43,44, with their linking elbow 45 and their thrust and bearing finger 46 are advantageously made of damping material preferably elastomer, to better absorb the shocks. Like the pads 30,31, pads 43,44 may include a transverse rear bearing slice 50 made of damping material.

The invention claimed is:

1. A gas operated apparatus comprising:

a chamber adapted to be closed by a chamber sleeve tube and a cage adapted to be pressed against a workpiece, a piston adapted to be propelled in a cylinder and to drive a fastening element into the work piece the chamber sleeve tube and the cylinder being operatively interconnected such that the chamber is closed when the chamber sleeve tube comes into abutment against the cylinder, and wherein the apparatus further comprises:

means for permitting damped relative movement between the chamber sleeve tube and the cage.

2. The apparatus according to claim 1, wherein the relative movement permitting means comprises:

at least one bearing and at least one thrust and connecting pad arrange to come into abutment against a bearing flange of the cylinder in the closed position;

at least one connecting pin for connecting the chamber sleeve tube, the bearing pad and the cage, and at least one spring for opening the chamber in abutment against the bearing flange and the bearing pad.

3. The apparatus according to claim 2, in which the pad has a bearing finger of narrowed cross section configured to bear against the flange of the cylinder and receive the spring thereabout.

4. The apparatus according to claim 3, in which each bearing and thrust pad comprising a connection elbow in which a respective connecting pin is housed, the connecting elbow being associated with the finger and forming a groove configured to accommodate a nib of the cage.

5. The apparatus according to claim 2, in which the bearing pads comprise at least a transverse rear bearing slice.

6. A gas operated apparatus comprising:

a chamber closed by a chamber sleeve tube and a cage when the apparatus is pressed against a workpiece, a piston propelled in a cylinder and adapted to drive a fastening element into the work piece, the chamber sleeve tube and the cylinder being operatively interconnected such that the chamber is closed as the chamber sleeve tube comes into abutment against the cylinder, and wherein the chamber sleeve tube comprises at least one pin and a pad of damping material through which the pin extends, operatively connecting the chamber sleeve tube and the cage so as to permit relative movement between the chamber sleeve tube and the cage.

7. A gas operated apparatus comprising:

a chamber closed by a chamber sleeve tube and a cage when the apparatus is pressed against a workpiece, a piston propelled in a cylinder and adapted to drive a fastening element into the work piece, the chamber sleeve tube and the cylinder being operatively interconnected such that the chamber is closed as the chamber sleeve tube comes into abutment against the cylinder, and wherein the cage and the chamber sleeve tube are operatively connected with one another so as to be slidable with respect to one another.

8. The apparatus according to claim 7, in which the chamber sleeve tube comprises at least one bearing pad configured to come into abutment with a bearing lug of the cylinder.

9. The apparatus according to claim 8, in which the the at least one bearing pad comprises at least a transverse rear bearing slice.

10. The apparatus according to claim 8, in which the chamber sleeve tube comprises at least one lug acting as a support for an opening spring which spring also bears against a flange of the cylinder.

11. The apparatus according to claim 8, wherein the cage and the chamber sleeve tube are relatively movable through a distance which is essentially equal to the distance separating a bearing and thrust lug and the associated connecting pin.

12. The apparatus according to claim 7, in which the chamber sleeve tube comprises at least one lug acting as a support for an opening spring, which spring also bears against a flange of the cylinder.

13. The apparatus according to claim 12, wherein the cage and the chamber sleeve tube are relatively movable through a distance which is essentially equal to the distance separating a bearing and thrust lug and the associated connecting pin.

14. The apparatus according to claim 7, wherein the cage and the chamber sleeve tube are relatively movable through a distance which is essentially equal to the distance separating a bearing and thrust lug and the associated connecting pin.

* * * * *